US010614947B2

(12) United States Patent
Nakano et al.

(10) Patent No.: US 10,614,947 B2
(45) Date of Patent: Apr. 7, 2020

(54) COIL COMPONENT

(71) Applicant: MURATA MANUFACTURING CO., LTD., Kyoto-fu (JP)

(72) Inventors: Maasa Nakano, Nagaokakyo (JP); Hideji Kihara, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 15/596,411

(22) Filed: May 16, 2017

(65) Prior Publication Data

US 2017/0345552 A1 Nov. 30, 2017

(30) Foreign Application Priority Data

May 26, 2016 (JP) ..... 2016-105472

(51) Int. Cl.
*H01F 27/24* (2006.01)
*H01F 27/28* (2006.01)
(Continued)

(52) U.S. Cl.
CPC ..... *H01F 27/2804* (2013.01); *H01F 17/0013* (2013.01); *H01F 17/04* (2013.01);
(Continued)

(58) Field of Classification Search
CPC .. H01F 17/0013; H01F 17/04; H01F 27/2804; H01F 27/27; H01F 27/29;
(Continued)

(56) References Cited

U.S. PATENT DOCUMENTS 6,762,925 B2 * 7/2004 Uchida ..... H03H 7/0115 361/321.1
7,251,120 B2 * 7/2007 Takazawa ..... H01F 17/0013 361/311
(Continued)

FOREIGN PATENT DOCUMENTS

CN 1624826 A 6/2005
CN 104143404 A 11/2014
(Continued)

OTHER PUBLICATIONS

An Office Action mailed by the Chinese Patent Office dated Aug. 3, 2018, which corresponds to Chinese Patent Application No. 201710372698.3 and is related to U.S. Appl. No. 15/596,411.
An Office Action; "Notice of Reasons for Refusal," mailed by the Japanese Patent Office dated Nov. 13, 2018, which corresponds to Japanese Patent Application No. 2016-105472 and is related to U.S. Appl. No. 15/596,411 (and is related to the present application); with English language translation.

*Primary Examiner* — Mang Tin Bik Lian
(74) *Attorney, Agent, or Firm* — Studebaker & Brackett PC

(57) ABSTRACT

A coil component including an element assembly that includes a magnetic portion and a coil-like conductor portion embedded in the magnetic portion and outer electrodes disposed on an outer surface of the element assembly, wherein the outer surface has a mounting surface parallel to the central axis of a coil, the magnetic portion includes a first portion, a second portion, and a third portion, the first portion and the third portion contain glass and ferrite and have ferrite contents of 40 percent by volume or more, the second portion contains glass and ferrite and has a ferrite content smaller than the ferrite contents in the first portion and the third portion, and each of the first portion and the third portion has a covered region that is covered with the outer electrode and an exposed region that is not covered with the outer electrode on the mounting surface.

10 Claims, 5 Drawing Sheets

(51) Int. Cl.

| | |
|---|---|
| ***H01F 17/00*** | (2006.01) |
| ***H01F 17/04*** | (2006.01) |
| ***H01F 41/04*** | (2006.01) |
| ***H01F 27/29*** | (2006.01) |

(52) U.S. Cl.
CPC ..... *H01F 27/24* (2013.01); *H01F 27/29* (2013.01); *H01F 27/292* (2013.01); *H01F 41/041* (2013.01); *H01F 41/043* (2013.01); *H01F 41/046* (2013.01); *H01F 2027/2809* (2013.01)

(58) Field of Classification Search
CPC ..... H01F 27/255; H01F 27/292; H01F 2027/2809; H01F 41/041; H01F 41/043; H01F 41/046
USPC ..... 336/200, 192, 233, 223
See application file for complete search history.

(56) References Cited

U.S. PATENT DOCUMENTS

| | | | | |
|---|---|---|---|---|
| 9,305,690 | B2 * | 4/2016 | Choto | H01F 1/401 |
| 2005/0018382 | A1 * | 1/2005 | Takazawa | H01F 17/0013 361/321.2 |
| 2016/0042859 | A1 * | 2/2016 | Park | H01F 17/0013 336/200 |

FOREIGN PATENT DOCUMENTS

| | | | |
|---|---|---|---|
| JP | H10-338545 | A | 12/1998 |
| JP | 2002270428 | A | 9/2002 |
| JP | 2002319508 | A | 10/2002 |
| JP | 2006310844 | A | 11/2006 |
| JP | 2014-220469 | A | 11/2014 |

* cited by examiner

COIL COMPONENT

CROSS REFERENCE TO RELATED APPLICATIONS

This application claims benefit of priority to Japanese Patent Application 2016-105472 filed May 26, 2016, the entire content of which is incorporated herein by reference.

TECHNICAL FIELD

The present disclosure relates to a coil component and a method for manufacturing the same.

BACKGROUND

Coil components are widely used as, for example, measures against noise of electronic equipment. An electronic component, in which a coil conductor is embedded inside a magnetic composition containing ferrite, has been proposed as the coil component.

For example, Japanese Unexamined Patent Application Publication No. 2014-220469 describes a composite ferrite composition containing a magnetic material and a nonmagnetic material, wherein the mixing ratio of the magnetic material to the nonmagnetic material is 20 percent by weight:80 percent by weight to 80 percent by weight:20 percent by weight, the magnetic material is a Ni—Cu—Zn-based ferrite, the primary component of the nonmagnetic material contains at least oxides of Zn, Cu, and Si, and the secondary component of the nonmagnetic material contains borosilicate glass. Also, Japanese Unexamined Patent Application Publication No. 2014-220469 describes an electronic component formed by stacking a coil conductor and a ceramic portion, wherein the coil conductor contains Ag and the ceramic portion is composed of the above-described composite ferrite composition, and a composite electronic component.

SUMMARY

In recent years, coil components usable for high frequency applications, for example, impedance elements of high frequency circuits, have been required. Meanwhile, electronic components with high strength and high reliability have also been required.

Accordingly, it is an object of the present disclosure to provide a coil component having good high frequency characteristics and excellent strength and a method for manufacturing the same.

The present inventors found that the high frequency characteristics of a coil component could be improved by decreasing the ferrite content in a magnetic portion of the coil component. However, it was made clear that if the ferrite content in the magnetic portion decreased, the strength of an element assembly had a tendency to degrade. The present inventors performed intensive investigation and, as a result, found that the compatibility between good high frequency characteristics and excellent strength could be ensured by setting the ferrite content of a place, in which cracking occurred easily, in a magnetic portion to be more than or equal to a specific value. Consequently, the present disclosure was completed.

A first aspect according to preferred embodiments of the present disclosure provides a coil component including an element assembly that includes a magnetic portion and a coil-like conductor portion embedded in the magnetic portion and a pair of outer electrodes disposed on an outer surface of the element assembly, wherein the outer surface of the element assembly has a mounting surface parallel to the central axis of a coil, the magnetic portion includes a first portion, a second portion, and a third portion that are sequentially located in a direction parallel to the central axis, at least part of a winding portion of the conductor portion is embedded in the second portion, the first portion and the third portion contain glass and ferrite and have ferrite contents of about 40 percent by volume or more, the second portion contains glass and ferrite and has a ferrite content smaller than the ferrite contents in the first portion and the third portion, and each of the first portion and the third portion has a covered region that is covered with the outer electrode and an exposed region that is not covered with the outer electrode on the mounting surface.

The coil component according to preferred embodiments of the present disclosure has the above-described features and, thereby, has good high frequency characteristics and excellent strength.

A second aspect according to preferred embodiments of the present disclosure provides a method for manufacturing a coil component that includes an element assembly including a magnetic portion and a coil-like conductor portion embedded in the magnetic portion and a pair of outer electrodes disposed on an outer surface of the element assembly, the method including the steps of preparing a first mixture containing glass and ferrite and having a ferrite content of about 40 percent by volume or more and a second mixture containing glass and ferrite and having a ferrite content smaller than the ferrite content in the first mixture, forming first sheets by molding the first mixture, forming second sheets by molding the second mixture, forming conductor patterns by applying a conductor paste to the second sheets, forming a multilayer body by stacking the second sheets provided with the conductor patterns such that the conductor patterns are connected to each other, into the shape of a coil, through the conductor paste, with which via holes penetrating the second sheets are filled and, in addition, stacking the first sheets on the top and the bottom such that the conductor patterns are connected to the conductor paste, with which via holes penetrating the first sheets are filled, producing an element assembly by firing the multilayer body, where the outer surface of the element assembly has a mounting surface parallel to the central axis of a coil, the magnetic portion of the element assembly includes a first portion, a second portion, and a third portion that are sequentially located in a direction parallel to the central axis, the first portion and the third portion are produced by firing the first sheets, and the second portion is produced by firing the second sheets, and forming outer electrodes on the outer surface of the element assembly by applying an outer electrode paste to the outer surface of the element assembly so as to cover part of the mounting surface of each of the first portion and the third portion and by performing baking.

The method for manufacturing a coil component according to preferred embodiments of the present disclosure has the above-described features and, thereby, can produce a coil component having good high frequency characteristics and excellent strength.

Other features, elements, characteristics and advantages of the present disclosure will become more apparent from the following detailed description of preferred embodiments of the present disclosure with reference to the attached drawings.

DETAILED DESCRIPTION

Figure 1:
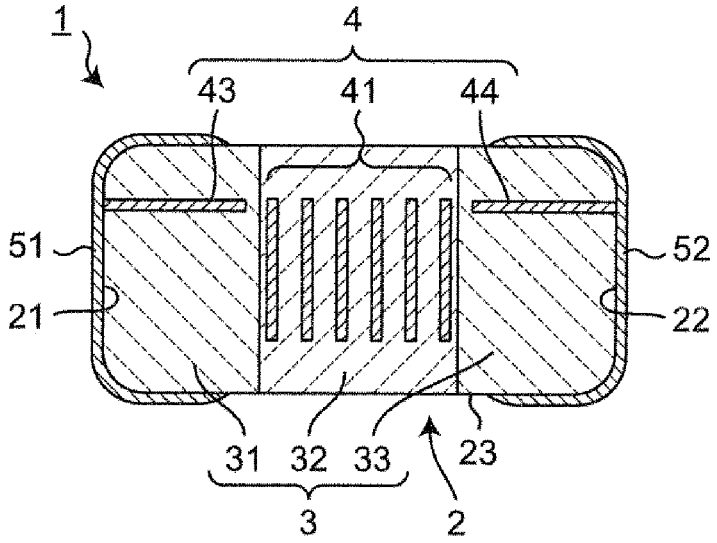
FIG. 1 is a schematic sectional view showing a first configuration example of a coil component according to an embodiment of the present disclosure.
Figure 2:
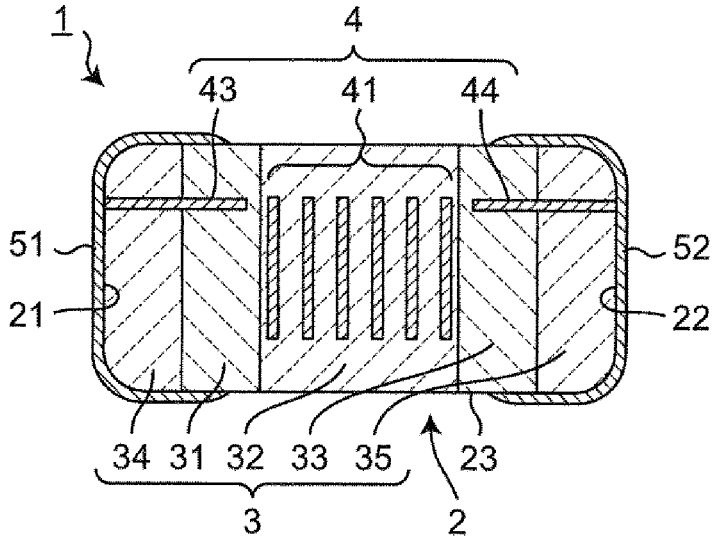
FIG. 2 is a schematic sectional view showing a second configuration example of a coil component according to an embodiment of the present disclosure.
Figure 3:
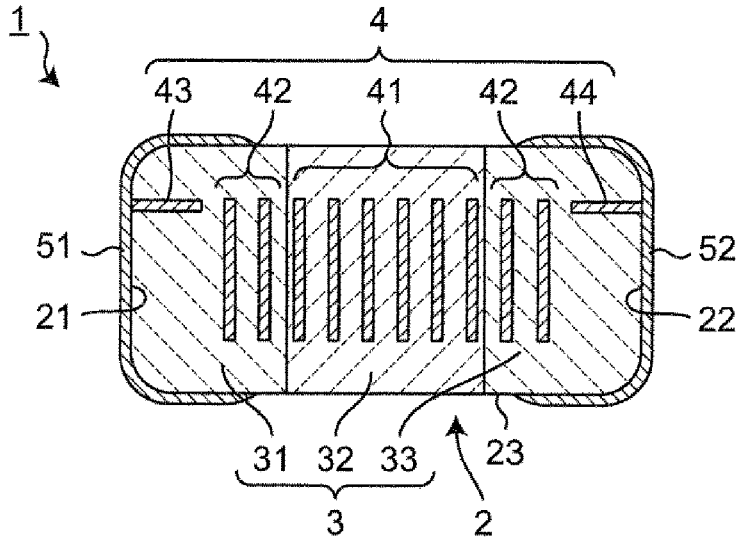
FIG. 3 is a schematic sectional view showing a third configuration example of a coil component according to an embodiment of the present disclosure.
Figure 4:
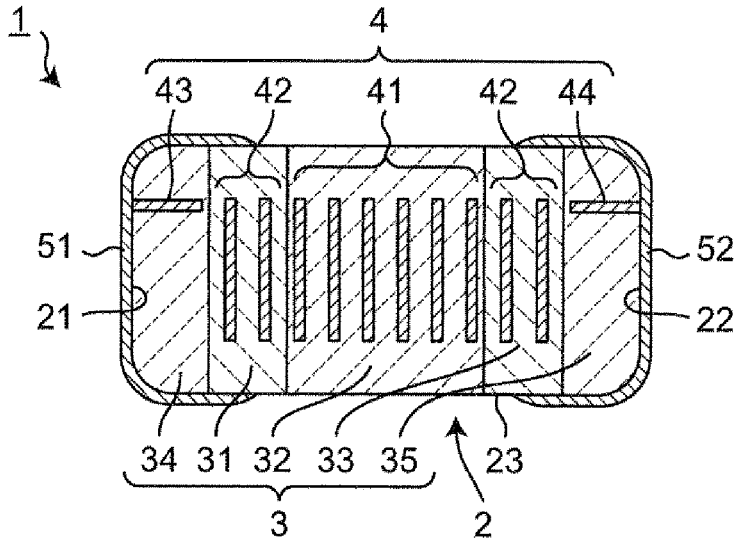
FIG. 4 is a schematic sectional view showing a fourth configuration example of a coil component according to an embodiment of the present disclosure.

The embodiments according to the present disclosure will be described below with reference to the drawings. However, the embodiments described below are for the purpose of exemplification, and the present disclosure is not limited to the embodiments below. Dimensions, materials, shapes, relative arrangements, and the like of constituents described below are merely examples for explanations and the scope of the present disclosure is not limited thereto unless otherwise specified. The sizes, shapes, positional relationships, and the like of the constituents shown in each drawing may be exaggerated for the purpose of clarifying illustration.

Coil Component

A coil component according to an embodiment of the present disclosure will be described below. FIGS. 1 to 4 are schematic sectional views showing first to fourth configuration examples of a coil component according to an embodiment of the present disclosure. A coil component 1 includes an element assembly 2 that includes a magnetic portion 3 and a coil-like conductor portion 4 embedded in the magnetic portion 3 and a pair of outer electrodes 51 and 52 disposed on an outer surface of the element assembly 2. The shape and the dimensions of the element assembly 2 are not specifically limited and may be set in accordance with an application. The shape of the element assembly 2 may be, for example, a substantially rectangular parallelepiped shown in FIG. 1. The outer surface of the element assembly 2 has a mounting surface 23 parallel to the central axis of a coil. In the coil component 1 shown in FIG. 1, the conductor portion 4 is disposed such that the central axis of the coil is parallel to long sides of the element assembly 2. The coil component 1 has such a configuration and, thereby, can have good high frequency characteristics.

The magnetic portion 3 includes a first portion 31, a second portion 32, and a third portion 33 that are sequentially located in a direction parallel to the central axis of the coil. At least part of a winding portion of the conductor portion 4 is embedded in the second portion 32. In the first configuration example shown in FIG. 1 and the second configuration example shown in FIG. 2, the entire winding portion (denoted by reference numeral 41) of the conductor portion 4 is embedded in the second portion 32. Meanwhile, in the third configuration example shown in FIG. 3 and the fourth configuration example shown in FIG. 4, part of the winding portion (denoted by reference numeral 41) is embedded in the second portion 32.

The first portion 31 and the third portion 33 contain glass and ferrite and have ferrite contents of about 40 percent by volume or more. The second portion 32 contains glass and ferrite. The ferrite content in the second portion 32 is smaller than the ferrite contents in the first portion 31 and the third portion 33. Consequently, the dielectric constant of the second portion 32 is lower than the dielectric constants of the first portion 31 and the third portion 33. At least part of the winding portion of the conductor portion 4 is embedded in the second portion 32 and, therefore, the composition of the second portion 32 has a large influence on the characteristics of the coil component. As a result, the high frequency characteristics of the coil component 1 can be improved by setting the dielectric constant of the second portion 32 to be lower than the dielectric constants of the first portion 31 and the third portion 33.

Preferably, the entire winding portion is embedded in the second portion 32. In this case, the high frequency characteristics of the coil component 1 can be further improved.

As shown in FIG. 1, the first portion 31 has a covered region that is covered with an outer electrode 51 and an exposed region that is not covered with the outer electrode 51 on the mounting surface 23. Likewise, as shown in FIG. 1, the third portion 33 has a covered region that is covered with an outer electrode 52 and an exposed region that is not covered with the outer electrode 52 on the mounting surface 23. That is, the first portion 31 and the third portion 33 of the magnetic portion 3 have borders between covered regions that are covered with the outer electrode 51 and the outer electrode 52, respectively, and exposed regions that are not covered with the outer electrode 51 and the outer electrode 52, respectively, on the mounting surface 23. The borders between the covered regions and the exposed regions are present in the first portion 31 and the third portion 33, each containing about 40 percent by volume of ferrite, on the mounting surface 23 and, thereby, the strength of the coil component 1 can be enhanced and occurrence of cracking during mounting of the coil component 1 can be suppressed.

The mechanism of enhancing the strength of the coil component 1 by setting the ferrite content in the first portion 31 and the third portion 33 to be about 40 percent by volume or more is roughly considered to be as described below, although there is no particular limitation regarding the theory about the mechanism. In the case where the coil component is mounted on the substrate by using reflow, cracking may occur in the coil component because a load is applied to the coil component. A load is easily applied to the mounting surface (surface on the side of mounting on the substrate) of the element assembly during reflow mounting. In particular, the border portions between the covered regions covered with the outer electrodes and the exposed regions not covered with the outer electrodes on the mounting surface tend to serve as start points of cracking. In the case where the ferrite content in the magnetic portion is decreased for the purpose of improving the high frequency characteristics of the coil component, the strength of the element assembly tends to degrade and, therefore, occurrence of cracking becomes a noticeable problem. The present inventors found that the high frequency characteristics could be improved by decreasing the ferrite content at and around the center of the magnetic portion, in which the winding portion of the conductor portion was embedded, and the strength of the element assembly at the borders, which could serve as the start points of cracking, could be enhanced so as to suppress occurrence of cracking by setting the ferrite contents at and around the borders between the covered regions and the exposed regions on the mounting surface to be about 40 percent by volume or more. It is considered that, as the ferrite content increases, ferrite-to-ferrite coupling is enhanced and the strength of the element assembly is enhanced. In the case where the ferrite contents at and around the borders between the covered regions and the exposed regions on the mounting surface are about 40 percent by volume or more, the element assembly strength sufficient for suppressing occurrence of cracking can be obtained. In the coil component 1 according to the present embodiment, the borders between the covered regions and the exposed regions on the mounting surface 23 are present in the first portion 31 and the third portion 33, each containing about percent by volume or more of ferrite. Therefore, the strength of the coil component 1 can be enhanced and, as a result, reflow mounting of the coil component 1 can be performed. In this manner, the compatibility between good high frequency characteristics and excellent strength can be ensured.

The upper limits of the ferrite contents in the first portion 31 and the third portion 33 are not specifically limited as long as the ferrite content is about 40 percent by volume or more. The ferrite contents in the first portion 31 and the third portion 33 are preferably 50 percent by volume or more and 60 percent by volume or less. In the case where the ferrite content is within the above-described range, the strength of the coil component can be further enhanced while good high frequency characteristics are maintained. The ferrite content in the first portion 31 and the ferrite content in the third portion 33 may be the same or be different from each other.

In the case where the ferrite content in the second portion 32 is smaller than the ferrite contents in the first portion 31 and the third portion 33, the high frequency characteristics of the coil component 1 can be improved. In the case where the ferrite content in the first portion 31 is different from the ferrite content in the third portion 33, the ferrite content in the second portion 32 has to be smaller than the ferrite content in the first portion 31 or the ferrite content in the third portion 33, whichever is smaller. The ferrite content in the second portion 32 is preferably less than about 30 percent by volume. In the case where the ferrite content is less than about 30 percent by volume, the high frequency characteristics can be further improved. The ferrite content in the second portion 32 is more preferably about 10 percent by volume or more and about 20 percent by volume or less. In the case where the ferrite content is within the above-described range, still better high frequency characteristics can be achieved while excellent element assembly strength is maintained.

The width of the exposed region in a direction parallel to the central axis of the coil may be about 35% or less of the length between the two end surfaces, which intersect the central axis, of the element assembly 2, and preferably about 5% or more and about 15% or less. In the case where the width of the exposed portion is about 5% or more, occurrence of cracking can be further effectively suppressed. Meanwhile, the width of the covered region in a direction parallel to the central axis of the coil may be preferably about 5% or more and about 15% or less of the length between the two end surfaces, which intersect the central axis, of the element assembly 2 (that is, the length between an end surface 21 and an end surface 22). In the case where the width of the covered portion is about 5% or more, occurrence of cracking can be further effectively suppressed. As the widths of the covered region and the exposed region increase, the effect of suppressing occurrence of cracking tends to be enhanced.

At least part of an extension portion 43 and at least part of an extension portion 44 of the conductor portion 4 may be embedded in the first portion 31 and the third portion 33, respectively. For example, in the first configuration example shown in FIG. 1 and the third configuration example shown in FIG. 3, the entire extension portion 43 is embedded in the first portion 31, and the entire extension portion 44 is embedded in the third portion 33. Meanwhile, in the second configuration example shown in FIG. 2, part of the extension portion 43 is embedded in the first portion 31, and part of the extension portion 44 is embedded in the third portion 33.

In the first configuration example, the magnetic portion 3 is composed of the first portion 31, the second portion 32, and the third portion 33. Such a configuration has advantages that the types of sheets used in a production process described later can be reduced and the number of man-hours can be reduced.

The magnetic portion 3 may further include a fourth portion 34 opposite to the second portion 32 with the first portion 31 interposed therebetween and a fifth portion 35 opposite to the second portion 32 with the third portion 33 interposed therebetween. Specific examples of such a configuration include the second configuration example shown in FIG. 2 and a fourth configuration example shown in FIG. 4. At least part of an extension portion 43 and at least part of an extension portion 44 of the conductor portion 4 may be embedded in the fourth portion 34 and the fifth portion 35, respectively. For example, in the second configuration example shown in FIG. 2, part of the extension portion 43 is embedded in the fourth portion 34, and part of the extension portion 44 is embedded in the fifth portion 35. Meanwhile, in the fourth configuration example shown in FIG. 4, the entire extension portion 43 is embedded in the fourth portion 34, and the entire extension portion 44 is embedded in the fifth portion 35.

The fourth portion 34 and the fifth portion 35 contain glass and ferrite. The ferrite contents in the fourth portion and the fifth portion 35 are smaller than the ferrite contents in the first portion 31 and the third portion 33. In the case where the ferrite content in the first portion 31 is different from the ferrite content in the third portion 33, the ferrite contents in the fourth portion 34 and the fifth portion have to be smaller than the ferrite content in the first portion 31 or the ferrite content in the third portion 33, whichever is smaller. The ferrite content in the fourth portion 34 and the ferrite content in the fifth portion 35 may be the same or be different from each other. The ferrite contents in the fourth portion 34 and the fifth portion 35 are preferably less than about 30 percent by volume. The ferrite content in any one of the fourth portion 34 or the fifth portion 35 may be less than about 30 percent by volume. In the case where the ferrite content is less than about 30 percent by volume, the high frequency characteristics can be further improved. The ferrite contents in the fourth portion 34 and the fifth portion 35 are more preferably about 10 percent by volume or more and about 20 percent by volume or less. The ferrite content in any one of the fourth portion 34 or the fifth portion 35 may be about 10 percent by volume or more and about 20 percent by volume or less. In the case where the ferrite content is within the above-described range, still better high frequency characteristics can be achieved while excellent element assembly strength is maintained.

The second configuration example and the fourth configuration example further include the fourth portion 34 and the fifth portion 35 that have small ferrite contents. Therefore, the widths of the first portion 31 and the third portion 33 that have large ferrite contents can be reduced and, as a result, a region having a low dielectric constant can be increased in the magnetic portion 3. According to such a configuration, still better high frequency characteristics can be realized while the strength of portions that may serve as start points of cracking during reflow mounting is ensured. Further, the second configuration example, in which the entire winding portion (denoted by reference numeral 41 in FIG. 2) of the conductor portion 4 is embedded in the second portion 32, has better high frequency characteristics compared with the fourth configuration example in which merely part of the winding portion (denoted by reference numeral 41 in FIG. 4) is embedded in the second portion 32.

Parts of the winding portion of the conductor portion 4 may be embedded in the first portion 31 and the third portion 33 of the magnetic portion 3. Specific examples of such a configuration include the third configuration example shown in FIG. 3 and the fourth configuration example shown in FIG. 4. In the third configuration example, part of the winding portion (denoted by reference numeral 42) and the entire extension portion 43 are embedded in the first portion 31 and part of the winding portion (denoted by reference numeral 42) and the entire extension portion 44 are embedded in the third portion 33. In the fourth configuration example, part of the winding portion (denoted by reference numeral 42) is embedded in each of the first portion 31 and the third portion 33.

Each of the first portion 31, the second portion 32, the third portion 33, the fourth portion 34, and the fifth portion 35 of the magnetic portion 3 contains glass and ferrite. Each portion of the magnetic portion 3 may further contain an inorganic material, e.g., a ceramic filler. Components contained in each portion of the magnetic portion 3 will be described below.

Ferrite

It is preferable that ferrite be ferromagnetic ferrite which is a solid solution having a spinel structure. Examples of ferromagnetic ferrite having the spinel structure include Ni—Zn-based ferrite (including Ni—Zn—Cu-based ferrite), Mn—Zn-based ferrite, Mg—Zn-based ferrite, and Ni—Co-based ferrite. Each portion of the magnetic portion 3 may contain one type of ferrite or at least two types of ferrite. Most of all, Ni—Zn-based ferrite, and in particular Ni—Zn—Cu-based ferrite, is suitable for high frequency applications because the magnetic permeability is sufficiently high in a high frequency band. Consequently, a glass-ceramic-ferrite composition contains preferably Ni—Zn-based ferrite, and more preferably Ni—Zn—Cu-based ferrite.

The compositions of the ferrite contained in the portions of the magnetic portion 3 may be different from each other but are preferably the same. In the case where the compositions of the ferrite contained in the portions of the magnetic portion 3 are the same, occurrence of cracking in the element assembly during firing can be effectively suppressed in the production process described later, and co-sintering is easily performed. The ferrite contained in each portion of the magnetic portion 3 is preferably Ni—Zn—Cu-based ferrite. The Ni—Zn—Cu-based ferrite is suitable for high frequency applications because the magnetic permeability is sufficiently high in a high frequency band.

Glass

There is no particular limitation regarding the type of glass and, for example, borosilicate glass may be used. The borosilicate glass may contain alkali metal elements, e.g., Li, Na, and K. The composition and the content of the glass contained in each portion of the magnetic portion 3 can be appropriately set in accordance with an application. It is preferable that the glass contained in all portions of the magnetic portion 3 be borosilicate glass. In this regard, the compositions of the glass contained in the portions of the magnetic portion 3 may be different from each other. There is no particular limitation regarding the glass content in each portion of the magnetic portion 3, and the glass content can be appropriately adjusted in accordance with the ferrite content in each portion.

Ceramic Filler

There is no particular limitation regarding the type of the ceramic filler, and examples include alumina, forsterite, quartz, zirconia, willemite, cordierite, steatite, and mullite. Each portion of the magnetic portion 3 may contain one type of ceramic filler or at least two types of ceramic fillers. None of the portions of the magnetic portion 3 may contain a ceramic filler, or some portions of the magnetic portion 3 may contain ceramic fillers. In this regard, it is preferable that all the portions of the magnetic portion 3 contain ceramic fillers. The types of the ceramic fillers contained in the portions of the magnetic portion 3 may be different from each other but the same filler is preferable. There is no particular limitation regarding the ceramic filler content in each portion of the magnetic portion 3, and the ceramic filler content can be appropriately adjusted in accordance with the ferrite content in each portion. The ceramic filler content in each portion of the magnetic portion 3 may be, for example, less than about 30 percent by volume. In the case where the ceramic filler content is within this range, good high frequency characteristics can be obtained.

The flexural strength of the element assembly 2 can be enhanced by adding forsterite to the magnetic portion 3 and, as a result, occurrence of cracking during mounting can be further effectively suppressed. The coefficient of linear expansion of the element assembly 2 can be increased by adding quartz to the magnetic portion 3. As a result, thermal stress during mounting of the coil component 1 can be relaxed, and occurrence of cracking during mounting can be further effectively suppressed. Also, the strength of the element assembly can be enhanced by adding a crystalline material, e.g., alumina, to the magnetic portion 3.

As an example, the coil component 1 may have a configuration in which neither the first portion 31 nor the third portion 33 of the magnetic portion 3 contain forsterite, the second portion 32 contains forsterite, and all the first portion 31, the second portion 32, and the third portion 33 contain quartz.

Each portion of the magnetic portion 3 may contain zirconia in addition to the above-described glass, ferrite, and ceramic filler.

The composition of each portion of the magnetic portion in the coil component 1 can be identified by, for example, combining inductively coupled plasma-atomic emission spectroscopy (ICP-AES) and an X-ray diffraction method (XRD).

Conductor Portion

The coil component 1 includes the coil-like conductor portion 4. As shown in FIG. 1, the conductor portion 4 includes the winding portion 41 and extension portions 43 and 44 connected to both ends of the winding portion 41. The configuration of the conductor portion 4 will be described below with reference to a configuration example shown in FIG. 7. The winding portion of the conductor portion 4 is composed of coil pattern layers 45*a*, 45*b*, 45*c*, 45*d*, 45*e*, and 45*f* and connection conductors 46*b*, 46*c*, 46*d*, 46*e*, and 46*f*. The coil pattern layers 45*a*, 45*b*, 45*c*, 45*d*, 45*e*, and 45*f* are disposed between the magnetic layers 36*a* and 36*b*, the magnetic layers 36*b* and 36*c*, the magnetic layers 36*c* and 36*d*, the magnetic layers 36*d* and 36*e*, the magnetic layers 36*e* and 36*f*, and the magnetic layers 36*f* and 36*i*, respectively, where the magnetic layers constitute the magnetic portion 3. The coil pattern layers are connected to each other, into the shape of a coil, through the connection conductors 46*b*, 46*c*, 46*d*, 46*e*, and 46*f* that are disposed so as to penetrate the magnetic layers and, thereby, the winding portion is formed. The number of turns of the winding portion, the shapes, dimensions, arrangements, and the like of the coil pattern layers and the connection conductors are not limited to those in the configuration example shown in FIG. 7 and can be appropriately set in accordance with an application.

Figure 7:
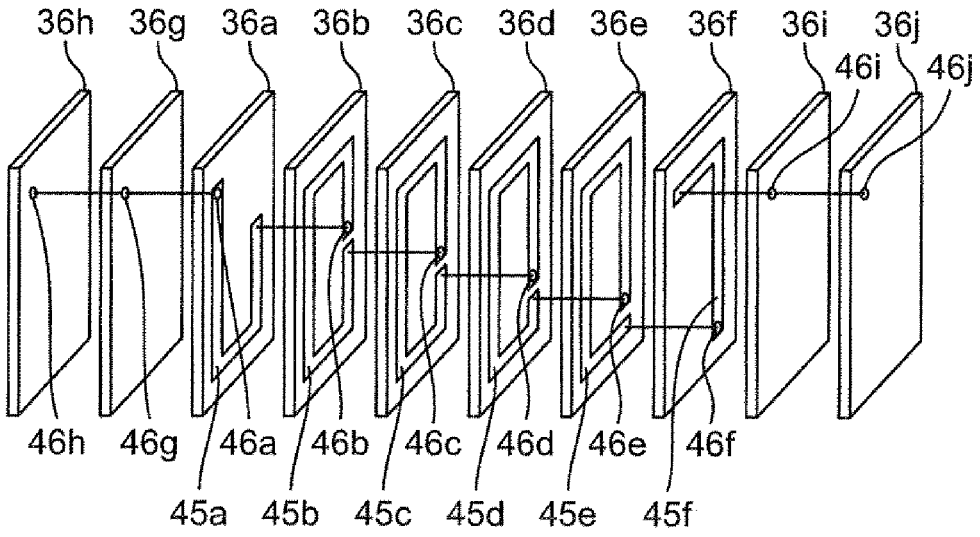
FIG. 7 is a schematic exploded perspective view of a coil component (excluding outer electrodes) according to an embodiment of the present disclosure.

In the configuration example shown in FIG. 7, the extension portion 43 of the conductor portion 4 is formed by connecting the connection conductors 46*a*, 46*g*, and 46*h*, to each other, that are disposed so as to penetrate the magnetic layers 36*a*, 36*g*, and 36*h*, respectively, constituting the magnetic portion 3. Likewise, the extension portion 44 is formed by connecting the connection conductors 46*i* and 46*j*, to each other, that are disposed so as to penetrate the magnetic layers 36*i* and 36*j*, respectively, constituting the magnetic portion 3. In the case of the configuration example shown in FIG. 7, the extension portions 43 and 44 extend to the two end surfaces 21 and 22, respectively, of the element assembly 2, as shown in FIG. 1, but the extension portions 43 and 44 may extend to a mounting surface 23 of the element assembly 2 as described later.

For example, in the case where the ferrite contents in the magnetic layers 36*g*, 36*h*, and 36*j* are set to be about 40 percent by volume or more in the configuration shown in FIG. 7, these magnetic layers constitute the first portion 31 and the third portion 33. In the case where the ferrite contents in the magnetic layers 36*a*, 36*b*, 36*c*, 36*d*, 36*e*, 36*f*, and 36*i* are set to be smaller than the ferrite contents in the first portion 31 and the third portion 33, these magnetic layers constitute the second portion 32 of the magnetic portion 3. The coil component 1 having the configuration 1 shown in FIG. 1 can be produced by setting the ferrite content of each of the magnetic layers as described above. Likewise, the coil components having the second configuration, the third configuration, and the fourth configuration can be produced by appropriately adjusting the ferrite content of each of the magnetic layers.

The conductor portion 4 may be composed of a conductor containing an electrically conductive material, e.g., silver, copper, platinum, palladium, or gold. The conductor portion may contain only one electrically conductive material or may contain at least two electrically conductive materials. In particular, silver has low conductor resistance. Therefore, the conductor portion is composed of preferably a conductor containing silver, and more preferably a conductor containing silver as a primary component, that is, a conductor substantially made of silver.

Outer Electrode

In the coil component 1 according to the present embodiment, the pair of electrodes 51 and 52 are disposed on the outer surface of the element assembly 2. Each of the first portion 31 and the third portion 33 of the magnetic portion 3 has a covered region covered with the outer electrode and an exposed portion not covered with the outer electrode on the mounting surface 23. Therefore, the outer electrodes 51 and 52 are disposed at least on the mounting surface 23.

In each of the configuration examples shown in FIGS. 1 to 4, one (51) of the pair of electrodes is disposed on one end surface 21, which intersects the central axis of the coil, of the element assembly 2 and, in addition, extends to part of each of the four surfaces, which are in contact with the end surface 21, of the element assembly 2. The other (52) of the pair of electrodes is disposed on the other end surface 22, which intersects the central axis of the coil, of the element assembly 2 and, in addition, extends to part of each of the four surfaces, which are in contact with the end surface 22, of the element assembly 2. The two ends of the conductor portion 4 are connected to the pair of outer electrodes 51 and 52 on the two end surfaces 21 and 22, respectively, which intersect the central axis of the coil, of the element assembly 2. More specifically, the end portion of the extension portion 43 of the conductor portion 4 extends to the end surface 21 of the element assembly 2 and is connected to the outer electrode 51 on the end surface 21. The end portion of the extension portion 44 of the conductor portion 4 extends to the end surface 22 of the element assembly 2 and is connected to the outer electrode 52 on the end surface 22.

Figure 5A:
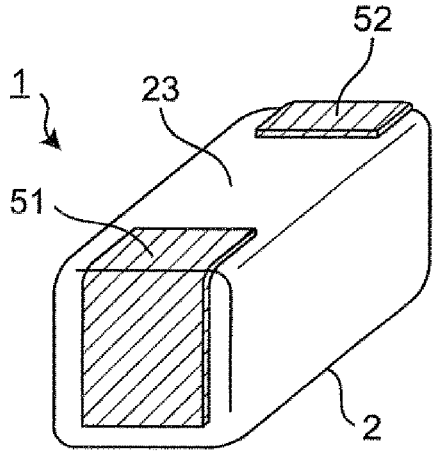
FIG. 5A is a schematic perspective view showing a first modified example of an outer electrode arrangement in a coil component according to an embodiment of the present disclosure, when viewed from below.
Figure 5B:
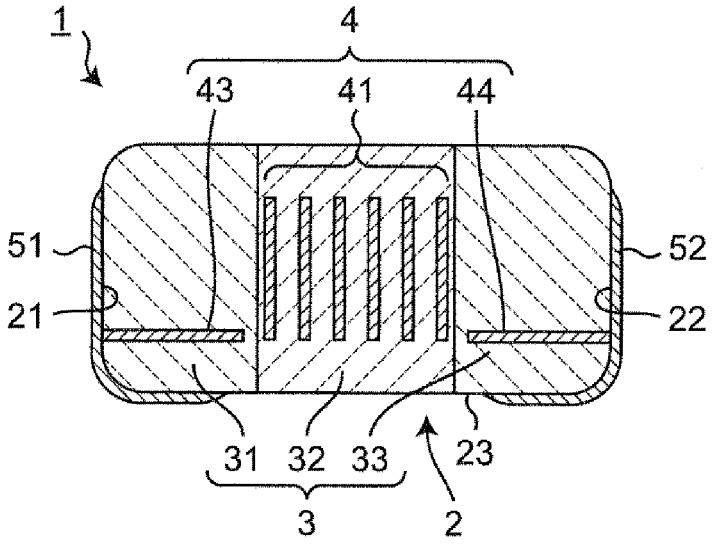
FIG. 5B is a schematic sectional view of the modified example shown in FIG. 5A.

FIGS. 5A and 5B show a first modified example of the outer electrode arrangement in a coil component. The first modified example is different from the configuration examples shown in FIGS. 1 to 4, in which one outer electrode is disposed over five surfaces of the element assembly, because one outer electrode is disposed over two surfaces of the element assembly. In the first modified example, one (51) of the pair of electrodes is disposed on one end surface 21, which intersects the central axis of the coil, of the element assembly 2 and, in addition, extends to part of the mounting surface 23 in contact with the end surface 21. The other (52) of the pair of electrodes is disposed on the other end surface 22, which intersects the central axis of the coil, of the element assembly 2 and, in addition, extends to part of the mounting surface 23 in contact with the end surface 22. The two ends of the conductor portion 4 are connected to the pair of outer electrodes 51 and 52 on the two end surfaces 21 and 22, respectively, which intersect the central axis of the coil, of the element assembly 2. More specifically, as shown in FIG. 5B, the end portion of the extension portion 43 of the conductor portion 4 extends to the end surface 21 of the element assembly 2 and is connected to the outer electrode 51 on the end surface 21. The end portion of the extension portion 44 of the conductor portion 4 extends to the end surface 22 of the element assembly 2 and is connected to the outer electrode 52 on the end surface 22. In this regard, the element assembly 2 of the coil component 1 shown in FIG. 5B has the same structure as the structure of the element assembly 2 in the first configuration example shown in FIG. 1. However, the structure of the element assembly 2 is not limited to this and may have the same structure as the structures of the element assemblies 2 in the second to fourth configuration examples.

Figure 6A:
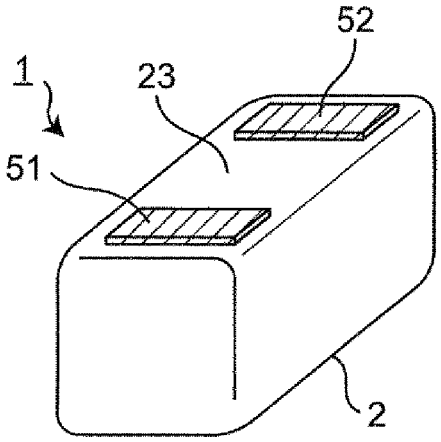
FIG. 6A is a schematic perspective view showing a second modified example of an outer electrode arrangement in a coil component according to an embodiment of the present disclosure, when viewed from below.
Figure 6B:
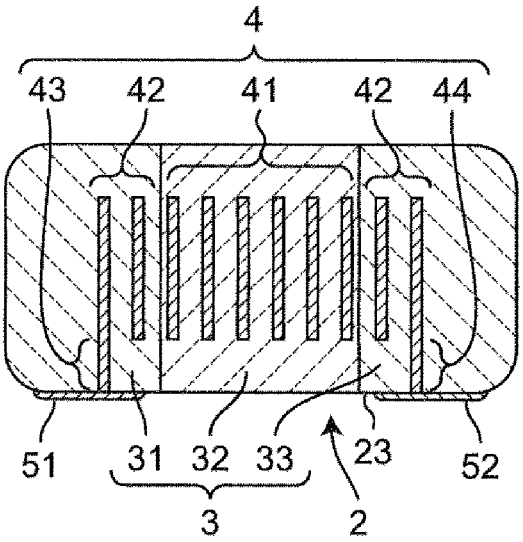
FIG. 6B is a schematic sectional view of the modified example shown in FIG. 6A.

FIGS. 6A and 6B show a second modified example of the outer electrode arrangement in a coil component. The second modified example is different from the configuration examples shown in FIGS. 1 to 4 and the first modified example shown in FIGS. 5A and 5B because outer electrodes are disposed on only the mounting surface of the element assembly. In the second modified example, both the pair of electrodes 51 and 52 are disposed on the mounting surface 23 of the element assembly 2. The two ends of the conductor portion 4 are connected to the pair of outer electrodes 51 and 52 on the mounting surface 23. More specifically, as shown in FIG. 6B, the end portion of the extension portion 43 of the conductor portion 4 extends to the mounting surface 23 of the element assembly 2 and is connected to the outer electrode 51 on the mounting surface 23. The end portion of the extension portion 44 of the conductor portion 4 extends to the mounting surface 23 of the element assembly 2 and is connected to the outer electrode 52 on the mounting surface 23. In this regard, the element assembly 2 of the coil component 1 shown in FIG. 6B has a structure similar to the structure of the element assembly 2 in the fourth configuration example shown in FIG. 4. However, the structure of the element assembly 2 is not limited to this and may have a structure similar to the structures of the element assemblies 2 in the first to third configuration examples.

Both the first modified example, in which one outer electrode is disposed over two surfaces of the element assembly, and the second modified example, in which the outer electrodes are disposed on only the mounting surface, can further effectively suppress occurrence of cracking compared with the configurations shown in FIGS. 1 to 4 in which one outer electrode is disposed over five surfaces of the element assembly. Also, the first and second modified examples have an advantage that a space can be saved. Further, the stray capacitance can be reduced because of the outer electrode arrangements according to the first and second modified examples and, as a result, the high frequency characteristics can be improved. In particular, the second modified example has advantages that still higher effects can be exerted on suppression of occurrence of cracking, space saving, and high frequency characteristics compared with the first modified example.

The outer electrode may be composed of a conductor containing an electrically conductive material, e.g., gold, silver, palladium, copper, or nickel. The conductor may contain only one electrically conductive material or may contain at least two electrically conductive materials. It is preferable that the outer electrode be composed of a conductor containing silver as a primary component. The outer electrodes may be plated with, for example, nickel and/or tin, as necessary.

The coil component may be, for example, a multilayer inductor.

Method for Manufacturing Coil Component

A method for manufacturing the coil component according to an embodiment of the present disclosure will be described below. In this regard, a method for manufacturing the coil component according to the first configuration example shown in FIG. 1 is described as an example. The coil components according to the second to fourth configuration examples can also be produced in the same manner by appropriately changing the method described below. The method for manufacturing the coil component is not limited to the method described below, and the coil component may be produced by appropriately adopting known technologies.

The method according to the present embodiment is a method for manufacturing a coil component including an element assembly that includes a magnetic portion and a coil-like conductor portion embedded in the magnetic portion and a pair of outer electrodes disposed on an outer surface of the element assembly. The method according to the present embodiment includes the steps of preparing a first mixture and a second mixture that contain glass and ferrite, forming first sheets by molding the first mixture, forming second sheets by molding the second mixture, forming conductor patterns by applying a conductor paste to the second sheets, forming a multilayer body by stacking the second sheets provided with the conductor patterns and stacking the first sheets, producing an element assembly by firing the multilayer body, and forming outer electrodes on the outer surface of the element assembly.

The first mixture containing glass and ferrite and having a ferrite content of about 40 percent by volume or more and the second mixture containing glass and ferrite and having a ferrite content smaller than the ferrite content in the first mixture are prepared. The ferrite content in the second mixture is preferably less than about 30 percent by volume. The first mixture and the second mixture may contain a ceramic filler in addition to the glass and the ferrite. Hereafter the first mixture and the second mixture may also be generically referred to as "mixture".

In this regard, it may be conjectured that the composition of the first mixture is substantially the same as the compositions of the first portion and the third portion, which are obtained by using the first mixture, of the magnetic portion. Also, it may be conjectured that the composition of the second mixture is substantially the same as the composition of the second portion, which is obtained by using the second mixture, of the magnetic portion. That is, it may be conjectured that the proportion (that is, content) of each of glass, ferrite, and ceramic filler relative to the total of glass, ferrite, and ceramic filler contained in each of the above-described mixtures are substantially the same as the proportion (content) of each of glass, ferrite, and ceramic filler, respectively, contained in the first portion, the second portion, or the third portion of the magnetic portion obtained by using the mixture.

Each of the first mixture and the second mixture may be contained in a paste or a slurry. The paste or the slurry may contain a solvent, e.g., toluene or ethanol, a binder resin, e.g., acryl or polyvinyl butyral, a plasticizer, e.g., octyl phthalate, a wetting agent, a dispersing agent, and the like in addition to the first mixture or the second mixture (that is, the above-described mixture of the glass, the ferrite, and in some cases the ceramic filler).

Each of the first mixture and the second mixture is produced by mixing predetermined proportions of glass powder, ferrite powder, and in some cases ceramic filler powder.

The first sheets are formed by molding the first mixture. In the case where the first mixture is molded, a slurry or a paste may be prepared by adding the above-described solvent, binder resin, plasticizer, wetting agent, dispersing agent, and the like to the mixture and performing mixing in a ball mill for a predetermined time, and the sheets may be formed by using the resulting slurry or paste. There is no particular limitation regarding the method for forming the sheets and, for example, a first green sheet can be formed by coating a release film with the above-described slurry or paste by using a comma coater. Subsequently, the first sheets can be produced by cutting the first green sheet into a predetermined size.

The second sheets are formed by molding the second mixture. The second sheets can be formed in the same procedure as the first sheets. In the case where the second mixture is molded, a slurry or a paste may be prepared by adding the above-described solvent, binder resin, plasticizer, wetting agent, dispersing agent, and the like to the mixture and performing mixing in a ball mill for a predetermined time, and the sheets may be formed by using the resulting slurry or paste.

Via holes that penetrate the sheets are made by using a laser at predetermined positions of the resulting first sheets and second sheets.

A conductor paste is applied to the second sheets so as to form conductor patterns. For example, the second sheets are coated with a conductor paste containing silver or a silver alloy as a primary component by using a screen printing method or the like so as to form predetermined patterns and, in addition, the via holes are filled with the conductor paste. The second sheets provided with the conductor patterns are dried by heating. The via holes of the first sheets are filled with the conductor paste.

The second sheets provided with the conductor patterns are stacked such that the conductor patterns are connected to each other, into the shape of a coil, through the conductor paste, with which via holes penetrating the second sheets are filled. In addition, the first sheets are stacked on the top and the bottom such that the conductor patterns are connected to the conductor paste, with which via holes penetrating the first sheets are filled, so as to form a multilayer body.

The thus obtained multilayer body is subjected to pressure bonding from above and below by using a mold provided with a high-hardness surface like a rigid body. The multilayer body subjected to pressure bonding is cut into a predetermined size by dicer cut. The resulting multilayer body is subjected to debinding.

The multilayer body subjected to debinding is fired so as to produce an element assembly including a magnetic portion and a coil-like conductor portion embedded in the magnetic portion. There is no particular limitation regarding the firing atmosphere. For example, in the case where a conductor paste containing a hard-to-oxidize material, e.g., silver, is used, firing may be performed in an air atmosphere, and in the case where a conductor paste containing an easy-to-oxidize material, e.g., copper, is used, firing is performed preferably in a low-oxygen atmosphere, e.g. a nitrogen atmosphere. There is no particular limitation regarding the firing temperature. The firing temperature may be, for example, about 1,000° C. or lower.

The outer surface of the resulting element assembly has a mounting surface parallel to the central axis of the coil. The magnetic portion of the element assembly includes a first portion, a second portion, and a third portion that are sequentially located in a direction parallel to the central axis of the coil. The first portion and the third portion are produced by firing the first sheets, and the second portion is produced by firing the second sheets.

An outer electrode paste is applied to the outer surface of the element assembly so as to cover part of the mounting surface of each of the first portion and the third portion. Application of the outer electrode paste can be appropriately performed such that the outer electrodes have predetermined shapes and arrangements. For example, in the case where the extension portions of the conductor portion are exposed at both end surfaces (denoted by reference numerals 21 and 22 in FIG. 1) of the element assembly, the outer electrode paste is also applied to both end surfaces of the element assembly. The outer electrodes are formed on the outer surface of the element assembly by baking the applied outer electrode paste. The baking condition can be appropriately set in accordance with the type of the outer electrode paste. The outer electrodes may be subjected to plating treatment in some cases. For example, a Ni plating liquid and a Sn plating liquid may be used, and the outer electrodes may be subjected to the plating treatment by using a rotating barrel plating apparatus.

In this manner, the coil component provided with the outer electrodes on the outer surface of the element assembly can be produced. The above-described manufacturing method has an advantage that the magnetic portion including the first portion, the second portion, and the third portion can be produced by a simple method which involves using two types of sheets (first sheets and second sheets) having ferrite contents different from each other.

EXAMPLES

Coil components of examples 1 to 3 and comparative examples 1 to 10 were produced in the procedure described below. Each of a first mixture and a second mixture was produced by mixing a ferrite powder, a glass powder, and a ceramic filler powder in proportions shown in the Table. A binder resin, a plasticizer, a wetting agent, and a dispersing agent were added to each of the mixtures, and mixing was performed in a ball mill for a predetermined time so as to produce a slurry containing the first mixture and a slurry containing the second slurry. Ni—Zn—Cu-based ferrite was used as the ferrite, and borosilicate glass was used as the glass.

A first green sheet and a second green sheet were produced by coating release films with the resulting respective slurries by using a comma coater. The first sheets and the second sheets were produced by cutting the first green sheet and the second green sheet, respectively, into a predetermined size. Via holes that penetrated the sheets were made by using a laser at predetermined positions of the resulting first sheets and second sheets.

The second sheets were coated with a conductor paste containing silver as a primary component by using screen printing so as to form predetermined patterns and, in addition, the via holes were filled with the conductor paste. The second sheets provided with the conductor patterns were dried by heating. The via holes of the first sheets were filled with the conductor paste.

The second sheets provided with the conductor patterns were stacked such that the conductor patterns were connected to each other, into the shape of a coil, through the conductor paste, with which via holes penetrating the second sheets were filled. In addition, a plurality of first sheets were stacked on the top and the bottom such that the conductor patterns were connected to the conductor paste, with which via holes penetrating the first sheets were filled, so as to form a multilayer body. The thus obtained multilayer body was subjected to pressure bonding from above and below by using a mold provided with a high-hardness surface like a rigid body and, thereafter, was cut into a predetermined size by dicer cut. The resulting multilayer body was subjected to debinding.

The multilayer body subjected to debinding was fired at 900° C. so as to produce an element assembly including a magnetic portion and a coil-like conductor portion embedded in the magnetic portion. The dimensions of the element assembly were 0.6 mm (length)×0.3 mm (width)×0.3 mm (thickness). As shown in FIG. 1, the magnetic portion of the element assembly included a first portion 31 and the third portion 33, which were produced by firing the first sheets, and the second portion 32 which was produced by firing the second sheets.

An outer electrode paste was applied to the outer surface of the element assembly so as to obtain outer electrodes in the arrangements shown in FIG. 1. The outer electrodes were formed on the outer surface of the element assembly by baking the outer electrode paste applied. The outer electrodes were subjected to plating treatment by using a Ni plating liquid and a Sn plating liquid and using a rotating barrel plating apparatus. In this manner, the coil components of examples 1 to 3 and comparative examples 1 to 10 were produced.

High Frequency Characteristics

Regarding the coil components of examples 1 to 3 and comparative examples 1 to 10, an impedance measurement was performed by using a network analyzer (N5222A produced by Keysight Technologies), and the high frequency characteristics were evaluated. The results are shown in the Table. In the case where the impedance curve had a peak in a region of 7 GHz or more and the peak value was more than 1,000Ω, the high frequency characteristics were rated as "excellent" and the result was expressed as "◎" in the Table. In the case where the impedance curve had a peak in a region of 5 GHz or more and 7 GHz or less and the peak value was more than 1,000Ω, the high frequency characteristics were rated as "good" and the result was expressed as "○" in the Table. In the case where the impedance curve had a peak in a region of 5 GHz or more and the peak value was 500Ω or more and 1,000Ω or less, the high frequency characteristics were rated as "acceptable" and the result was expressed as "Δ" in the Table. In the case where the impedance curve had a peak in a region of less than 5 GHz, the high frequency characteristics were rated as "poor" and the result was expressed as "x" in the Table.

Strength of Coil Component

The coil components of examples 1 to 3 and comparative examples 1 to 10 (the number of evaluations: n=100) were subjected to reflow mounting, and the strength of the coil component was evaluated by examining occurrence of cracking after the reflow mounting. The reflow mounting was performed by using an FR4 substrate as a mounting substrate and using lead-free solder as a solder paste. The peak temperature in the reflow mounting was about 260° C., and the number of times of reflow was three times. After the reflow mounting, solder was removed from the coil component by performing heating by a hot plate. The resulting coil component was encased in a resin, and a surface perpendicular to the mounting surface of the coil component and parallel to the central axis of the coil was polished to the center of the coil component so as to expose a cross section of the element assembly. The resulting cross section was observed by using a microscope so as to examine occurrence of cracking. The results are shown in the Table. In the case where the rate of occurrence of cracking due to reflow mounting was 0%, the strength was rated as "excellent" and the result was expressed as "◎" in the Table. In the case where cracking due to reflow mounting occurred at least once, that is, the rate of occurrence of cracking was more than 0%, the strength was rated as "poor" and the result was expressed as "x" in the Table.

TABLE

| | Composition (percent by volume) | | | | | | | | | |
|---|---|---|---|---|---|---|---|---|---|---|
| | First mixture | | | | Second mixture | | | | High frequency | |
| | Ferrite | Quartz | Alumina | Forsterite | Ferrite | Quartz | Alumina | Forsterite | characteristics | Strength |
| Example 1 | 40 | 18.0 | 0 | 0 | 10 | 26.2 | 0 | 2.7 | ⊙ | ⊙ |
| Example 2 | 40 | 18.0 | 0 | 0 | 15 | 24.7 | 0 | 2.6 | ⊙ | ⊙ |
| Example 3 | 40 | 18.0 | 0 | 0 | 20 | 23.3 | 0 | 2.4 | ○ | ⊙ |
| Comparative example 1 | 10 | 26.2 | 0 | 2.7 | 10 | 26.2 | 0 | 2.7 | ⊙ | × |
| Comparative example 2 | 10 | 26.2 | 2.7 | 0 | 10 | 26.2 | 2.7 | 0 | ⊙ | × |
| Comparative example 3 | 15 | 24.7 | 0 | 2.6 | 15 | 24.7 | 0 | 2.6 | ⊙ | × |
| Comparative example 4 | 15 | 24.7 | 2.6 | 0 | 15 | 24.7 | 2.6 | 0 | ⊙ | × |
| Comparative example 5 | 20 | 23.3 | 0 | 2.4 | 20 | 23.3 | 0 | 2.4 | ○ | × |
| Comparative example 6 | 30 | 21.0 | 0 | 0 | 30 | 21.0 | 0 | 0 | Δ | × |
| Comparative example 7 | 40 | 18.0 | 0 | 0 | 40 | 18.0 | 0 | 0 | × | ⊙ |
| Comparative example 8 | 20 | 23.3 | 2.4 | 0 | 15 | 24.7 | 2.6 | 0 | ○ | × |
| Comparative example 9 | 30 | 20.4 | 2.1 | 0 | 15 | 24.7 | 2.6 | 0 | ○ | × |
| Comparative example 10 | 30 | 20.4 | 2.1 | 0 | 10 | 26.2 | 2.7 | 0 | ⊙ | × |

*Remainder is glass

As shown in the Table, the coil components of examples 1 to 3 were capable of having compatibility between good high frequency characteristics and excellent strength. The reason for this is conjectured that the ferrite contents in the first portion and the third portion, which were produced by using the first mixture, were 40 percent by volume or more and the ferrite content in the second portion, which was produced by using the second mixture, was smaller than the ferrite contents in the first portion and the third portion. Also, it was found from examples 1 to 3 that the high frequency characteristics had a tendency to improve as the ferrite content in the second portion, which was produced by using the second mixture, of the magnetic portion became smaller. Specifically, it was found that the high frequency characteristics had a tendency to improve in the case where the ferrite content in the second portion, which was produced by using the second mixture, of the magnetic portion was within the range of 10 percent by volume or more and 20 percent by volume or less.

Regarding the coil component of each of comparative examples 1 to 7, the ferrite content in the first mixture was the same as the ferrite content in the second mixture and, thereby, the ferrite contents in the first portion, the second portion, and the third portion of the magnetic portion were the same. The strength of the coil component of each of comparative examples 1 to 6, in which ferrite contents in the first portion and the third portion were less than 40 percent by volume, was lower than the strength of each of the coil components of examples 1 to 3. Also, in comparative examples 1 to 7, the high frequency characteristics had a tendency to degrade as the ferrite content in the second portion increased, and the high frequency characteristics of the coil component of comparative example 7, in which the ferrite content in the second portion was 40 percent by volume were "poor (x)".

Regarding the coil component of each of comparative examples 8 to 10, the ferrite content in the second portion was smaller than the ferrite contents in the first portion and the third portion, but the ferrite contents of the first portion and the third portion were less than 40 percent by volume. Consequently, the strength of the coil component of each of comparative examples 8 to 10 was lower than the strength of each of the coil components of examples 1 to 3. It was found from comparative examples 8 to 10 that the high frequency characteristics had a tendency to improve as the ferrite content in the second portion decreased.

The coil component according to the present disclosure is usable for high frequency applications and can be used for wide applications, for example, impedance elements of high frequency circuits.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

an element assembly that includes a magnetic portion and a conductor portion including a coil which winds around a central axis and embedded in the magnetic portion; and a pair of outer electrodes disposed on an outer surface of the element assembly, wherein the outer surface of the element assembly has a mounting surface parallel to the central axis of the coil, the magnetic portion includes a first portion, a second portion, and a third portion that are sequentially located in a direction parallel to the central axis such that the first, second, and third portions overlap each other within an overlapping area when viewed in the direction parallel to the central axis, at least part of a winding portion of the conductor portion is embedded in the second portion, the first portion and the third portion contain glass and ferrite and have ferrite contents of 40 percent by volume or more, the second portion contains glass and ferrite and has a ferrite content smaller than the ferrite contents in the first portion and the third portion, each of the first portion and the third portion has a covered region that is covered with the outer electrode and an exposed region that is not covered with the outer electrode on the mounting surface, and the ferrite content of the second portion within the overlapping area is smaller than the ferrite content of each of the first and third portions within the overlapping area.

2. The coil component according to claim 1, wherein the ferrite content in the second portion is less than 30 percent by volume.

3. The coil component according to claim 1, wherein a width of the exposed region in a direction parallel to the central axis is less than or equal to 35% of a length between two end surfaces, which intersect the central axis, of the element assembly.

4. The coil component according to claim 1, wherein at least part of each of extension portions of the conductor portion is embedded in the first portion or the third portion.

5. The coil component according to claim 1, wherein parts of the winding portion are embedded in the first portion and the third portion.

6. The coil component according to claim 1, wherein one of the pair of outer electrodes is disposed on one end surface, which intersects the central axis, of the element assembly and extends to part of each of four surfaces, in contact with the end surface, of the element assembly, the other of the pair of outer electrodes is disposed on the other end surface, which intersects the central axis, of the element assembly and extends to part of each of the four surfaces, in contact with the end surface, of the element assembly, and two ends of the conductor portion are connected to the respective outer electrodes of the pair of outer electrodes on two end surfaces, which intersect the central axis, of the element assembly.

7. The coil component according to claim 1, wherein one of the pair of outer electrodes is disposed on one end surface, which intersects the central axis, of the element assembly and extends to part of the mounting surface in contact with the end surface, the other of the pair of outer electrodes is disposed on the other end surface, which intersects the central axis, of the element assembly and extends to part of the mounting surface in contact with the end surface, and two ends of the conductor portion are connected to the respective outer electrodes of the pair of outer electrodes on two end surfaces, which intersect the central axis, of the element assembly.

8. The coil component according to claim 1, wherein each of the pair of outer electrodes is disposed on the mounting surface, and two ends of the conductor portion are connected to the respective outer electrodes of the pair of outer electrodes on the mounting surface.

9. A coil component comprising:

an element assembly that includes a magnetic portion and a conductor portion including a coil which winds around a central axis and embedded in the magnetic portion; and a pair of outer electrodes disposed on an outer surface of the element assembly, wherein the outer surface of the element assembly has a mounting surface parallel to the central axis of the coil, the magnetic portion includes a first portion, a second portion, and a third portion that are sequentially located in a direction parallel to the central axis such that the first, second, and third portions overlap each other within an overlapping area when viewed in the direction parallel to the central axis, at least part of a winding portion of the conductor portion is embedded in the second portion, the first portion and the third portion contain glass and ferrite and have ferrite contents of 40 percent by volume or more, the second portion contains glass and ferrite and has a ferrite content smaller than the ferrite contents in the first portion and the third portion, each of the first portion and the third portion has a covered region that is covered with the outer electrode and an exposed region that is not covered with the outer electrode on the mounting surface, the ferrite content of the second portion within the overlapping area is smaller than the ferrite content of each of the first and third portions within the overlapping area, and wherein the magnetic portion further includes a fourth portion opposite to the second portion with the first portion interposed therebetween and a fifth portion opposite to the second portion with the third portion interposed therebetween, the first to fifth portions overlapping each other within the overlapping area when viewed in the direction parallel to the central axis, at least part of each of the extension portions is embedded in the fourth portion or the fifth portion, and the fourth portion and the fifth portion contain glass and ferrite and have ferrite contents smaller than the ferrite contents in the first portion and the third portion, and the ferrite contents of the fourth and fifth portions within the overlapping area is smaller than the ferrite content of each of the first and third portions within the overlapping area.

10. The coil component according to claim 9, wherein the ferrite content in the fourth portion and/or the ferrite content in the fifth portion is less than 30 percent by volume.

* * * * *